US008133073B2

(12) United States Patent
Buchberger et al.

(10) Patent No.: US 8,133,073 B2
(45) Date of Patent: Mar. 13, 2012

(54) HEADSET AND HEADSET CABLE

(75) Inventors: Jorg Buchberger, Peine (DE); Steffi Beier, Sarstedt (DE)

(73) Assignee: Sennheiser electronic GmbH & Co., KG, Wedemark (DE)

( * ) Notice: Subject to any disclaimer, the term of this patent is extended or adjusted under 35 U.S.C. 154(b) by 25 days.

(21) Appl. No.: 12/756,069

(22) Filed: Apr. 7, 2010

(65) Prior Publication Data

US 2011/0086550 A1 Apr. 14, 2011

(30) Foreign Application Priority Data

Apr. 8, 2009 (CA) ..... 2661693

(51) Int. Cl.
*H01R 11/00* (2006.01)

(52) U.S. Cl. ..... 439/502; 200/51.03

(58) Field of Classification Search ..... 439/49, 439/502, 620.21; 361/51.03, 51.04, 51.05, 361/51.06; 200/51.03, 51.04, 51.05, 51.06
See application file for complete search history.

(56) References Cited

U.S. PATENT DOCUMENTS

| | | | | |
|---|---|---|---|---|
| 6,608,264 | B1 * | 8/2003 | Fouladpour | 200/51.03 |
| 7,367,810 | B2 * | 5/2008 | Lee et al. | 439/49 |
| 7,377,805 | B2 * | 5/2008 | Kim et al. | 439/502 |
| 7,540,767 | B1 * | 6/2009 | Czarnecki | 439/517 |
| 7,824,211 | B1 * | 11/2010 | Wu | 439/502 |

* cited by examiner

*Primary Examiner* — Thanh Tam Le
(74) *Attorney, Agent, or Firm* — Kilpatrick Townsend & Stockton LLP

(57) ABSTRACT

A headset is provided which comprises a cable (100) having a plug (110) coupled to the first end of a cable (100), a connector (140) coupled to the second end of a cable, a housing (130) arranged between the first and second end of the cable and a cable section (120) between the plug (110) and the housing (130). The plug (110) comprises at least one pin and six terminals (**110*a*-100*f*). The cable section (120) comprises four wires (121, 123, 125, 126) and two screens (122, 124). The housing (130) comprises a connecting unit (134) having a switching unit (136) which is connected to the four wires (121, 123, 125, 126) and the two screens (122, 124) and the soldering areas (135) to which wires of the headset can be coupled. The switching unit (136) is adapted to switch between at least two wiring settings connecting the four wires as well as the two screens (122, 124) to the soldering areas (135**).

2 Claims, 2 Drawing Sheets

HEADSET AND HEADSET CABLE

CROSS-REFERENCE TO RELATED APPLICATIONS

The present application claims priority to Canadian Patent Application No. 2,661,693, filed Apr. 8, 2009, the entire contents of which are incorporated herein by reference for all purposes.

BACKGROUND

The present invention relates to a headset and a corresponding headset cable.

Headsets are widely used in airplanes as well as for air traffic control ATC. A headset typically comprises a boom microphone for detecting the speech from the wearer of the headset and one or two electro-acoustic transducers for reproducing audio signals.

It is an object of the invention to provide a headset and a corresponding headset cable which can be widely used around the world in particular for air traffic control.

SUMMARY

This object is solved by a headset according to claim 1 and a headset cable according to claim 4.

Therefore, a headset is provided which comprises a cable having a plug coupled to a first end of a cable, a connector coupled to a second end of a cable, a housing arranged between the first and second end of the cable and a cable section between the plug and the housing. The plug comprises at least one pin and six terminals. The cable section comprises four wires and two screens. The housing comprises a connecting unit having a switching unit which is connected to the four wires and the two screens and the soldering areas to which wires of the headset can be coupled. The switching unit is adapted to switch between at least two wiring settings connecting the four wires as well as the two screens to the soldering areas.

According to an aspect of the invention, the soldering areas comprise at least seven soldering points. The switching unit comprises six switches.

According to a further aspect of the invention, the headset comprises a first terminal of the first switch which is coupled to the first soldering point. The third terminal of the first switch is coupled to the sixth soldering point. The first terminal of the second switch is coupled to the third soldering point. The third terminal of the second switch is coupled to the seventh soldering point. The first terminal of the third switch is coupled to the sixth soldering point. The third terminal of the third switch is coupled to the PTT switch. The first terminal of the fourth switch is coupled to the seventh soldering point. The third terminal of the fourth switch is coupled to the fifth soldering point. The first terminal of the fourth switch is coupled to the PPT switch. The third terminal of the fourth switch is coupled to the first soldering point. The first terminal of the fifth switch is coupled to the PPT switch. The third terminal of the fifth switch is coupled to the third soldering point.

The invention also relates to a cable for a headset. The cable comprises a plug which is coupled to a first end of the cable, a connector coupled to a second end of the cable, a housing arranged between the first and second end of the cable and a cable section between the plug and the housing. The plug comprises at least one pin and six terminals. The cable section comprises four wires and two screens. The housing comprises a connecting unit having a switching unit which is connected to the four wires and the two screens and a soldering area to which wires of the headset can be coupled. The switching unit is adapted to switch between at least two wiring settings connecting the four wires as well as the two screens of the soldering areas.

The invention relates to the realization that various air traffic control ATC markets have different wiring standards for the cables of headsets. Therefore, different cables need to be provided for the respective air traffic control markets. In particular, the American and the Canadian air traffic control market have different requirements for the wiring of the connectors of the headsets.

According to the invention, a headset is provided which comprises a cable with a housing which includes a push-to-talk PTT switch as well as a connecting unit which enables a switching of different wiring settings of the plugs of the headset.

Further aspects of the invention are defined in the dependent claims.

BRIEF DESCRIPTION OF THE DRAWINGS

Embodiments and advantages of the present application will be described below with reference to the figures.

DETAILED DESCRIPTION

Figure 1A:
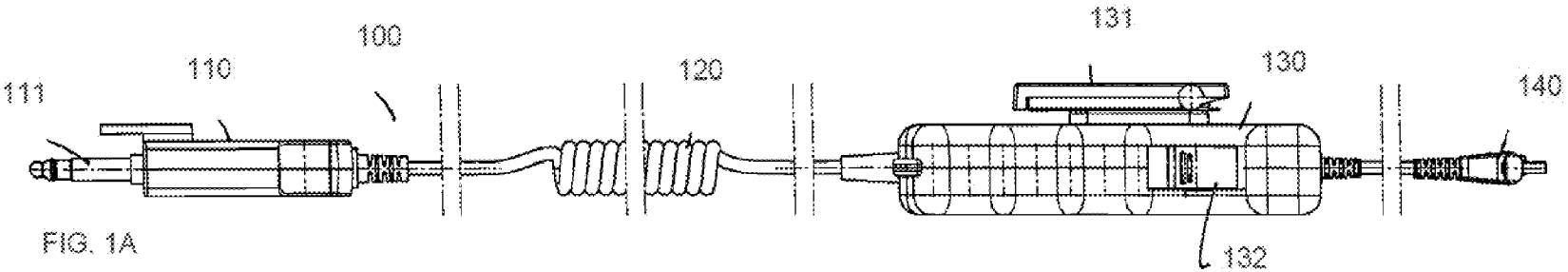
FIG. 1A, 1B each show a view of a cable for a headset according to a first embodiment.

FIG. lA and 1B each show a view on a cable for a headset according to a first embodiment. FIG. 1*a* shows a side view of the cable for a headset according to the first embodiment. The cable 100 comprises a plug 110 with two pins 111 at its first end and a connector 140 at its second end. The cable 100 furthermore comprises a coiled portion 120 and a housing 130 between the first and second end 110, 140 of the cable. The housing 130 can comprise a clip 131 for fastening for example to clothes of the user of the headset. The housing 130 also comprises a push-to-talk PTT button 132. The PTT button can be implemented as a JTP 1236A switch.

Figure 1B:
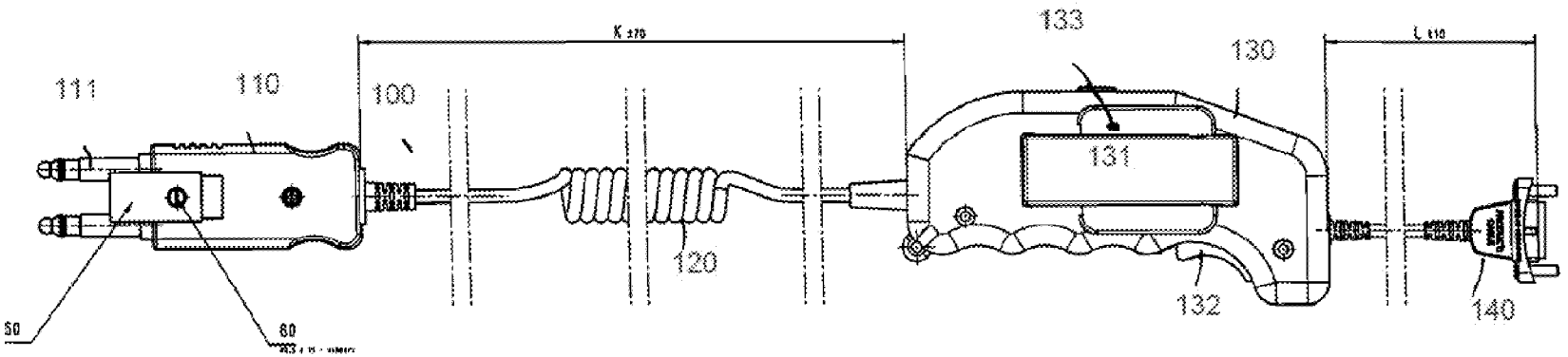

FIG. 1B shows a further view on the cable according to the first embodiment. The cable 100 also comprises a first plug 110 coupled to its first end and a connector 140 coupled to its second end. Furthermore, a coiled section 120 of the cable and the housing 130 are provided. As seen in FIG. 1A, the housing 130 comprises a clip 131 and a push-to-talk PTT button 132. The housing furthermore comprises a switch 133 (e. g. SSK-62 H01, a switch with 6 pins) for switching between different wiring settings. Preferably, the switch 133 is recessed into the housing 130.

Furthermore, the housing according to the first embodiment can be embodied in form of a "pistol grip".

According to the setting of the switch 133, the wiring of the first plug can be changed in accordance with the market in which this headset is to be used. The first plug 110 can be implemented as a PJ-07 plug.

Figure 2:
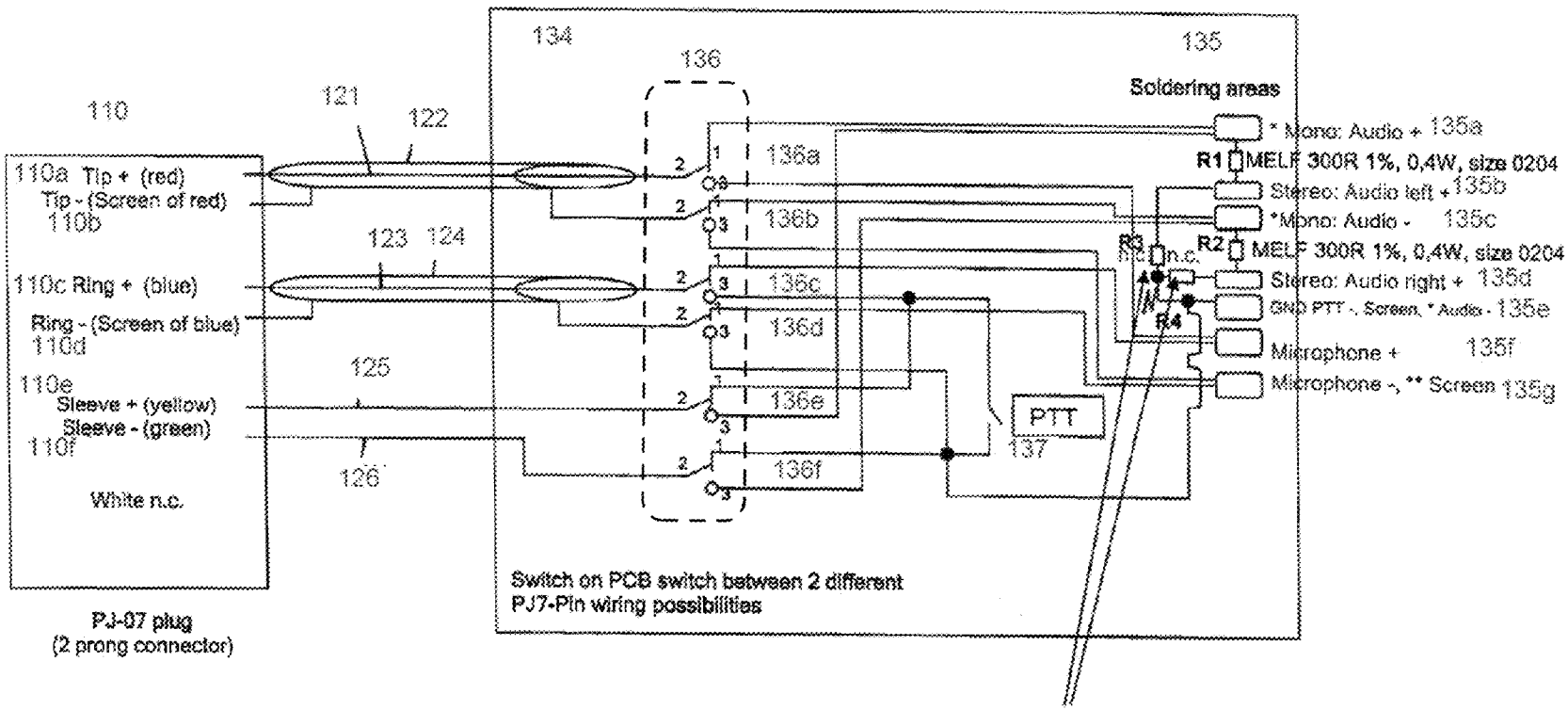
FIG. 2 shows a basic circuit diagram of the cable according to the first embodiment.

FIG. 2 shows a circuit diagram of a cable of a headset according to a second embodiment. The circuit diagram of FIG. 2 depicts the wiring of the cable as shown in FIG. 1A and 1B. Here, a plug 110, the cable section 120 and a connecting unit 134 are depicted. The plug 110 has six terminals 110*a*-110*f* to which the cable 120 is connected. Therefore, the plug 110 will comprise six terminals, namely a first terminal 110*a* for Tip+(red cable), a second terminal 110*b* for Tip−(the screen of red cable), a third terminal 110*c* for Ring+(blue cable), a fourth terminal 110*d* for Ring−(being the screen of the blue cable), a fifth terminal 110*e* for Sleeve+(yellow cable) and a sixth terminal 110*f* for Sleeve−(being the green cable). The first terminal 110*a* is coupled to a wire 121 (red). The second terminal 110*b* is coupled to the screen 122 of the wire 121 (red). The third terminal 110*c* is coupled to the second wire 123 (blue wire). The fourth terminal 110*d* is coupled to the second screen 124 of the second wire 123. The fifth terminal 110*e* is coupled to the third wire 125 and the sixth terminal 110*f* is coupled to the fourth wire 126. The connecting unit 134 is preferably implemented in the housing 130.

The connecting unit 134 comprises a switch unit 136, a PTT switch 137, several resistors R1-R4 and seven soldering areas 135. The switching unit 136 comprises sixth switches 136*a* -136*f*. Each switch 136*a* -136*f* comprises three terminals 1-3. The wires and the screens 121-126 are each coupled to the second terminal of each switch. The first switch 136*a* is coupled with its second terminal to the first wire 121. The second switch 136*b* is coupled with its second terminal to the first screen 122 of the first wire 121. The third switch 136 is coupled with its second terminal to the second wire 123 and the fourth switch 136*d* is coupled with its second terminal to the second screen 124 of the second wire 123. The fifth switch 136*e* is coupled with its second terminal to the third wire 125 and the sixth switch 136*f* is coupled to the fourth wire 126.

The soldering areas 135 comprise seven soldering points 135*a* -135*g*. It should be noted that further soldering points may be provided for further electrical or electronic components. The first soldering point 135*a* serves for an Audio+ signal for a mono operation. The second soldering point 135*b* serves as Audio left+signal for a stereo operation. The third soldering point 135*c* serves as an Audio−signal for a mono operation. The fourth soldering point 135*d* serves as an Audio right+signal for a stereo operation. The fifth soldering point 135*e* serves as ground for the PTT switch, for the first and second screen and for an audio−signal. The sixth soldering point 135*f* serves for the Microphone+signal and the seventh soldering point 135*g* serves for the Microphone−signal and the screen.

The first terminal of the first switch 136*a* is coupled to the first soldering point 135*a*. The third terminal of the first switch 136*a* is coupled to the sixth soldering point 135*f*. The first terminal of the second switch 136*b* is coupled to the third soldering point 135*c*. The third terminal of the second switch 136*b* is coupled to the seventh soldering point 135*g*. The first terminal of the third switch 136*c* is coupled to the sixth soldering point 135*f*. The third terminal of the third switch 136*c* is coupled to the PTT switch 137. The first terminal of the fourth switch 136*d* is coupled to the seventh soldering point 135*g*. The third terminal of the fourth switch 136*d* is coupled to the fifth soldering point 135*e*. The first terminal of the fourth switch 136*e* is coupled to the PTT switch 137. The third terminal of the fourth switch 136*e* is coupled to the first soldering point 135*a*. The first terminal of the fifth switch 136*f* is coupled to the PTT switch 137. The third terminal of the fifth switch 136*f* is coupled to the third soldering point 135*c*.

A first resistor R1 is coupled between the first and second soldering point 135*a*, 135*b*. A second resistor R2 is coupled between the third and fourth soldering point 135*c*, 135*d*. A third resistor R3 is coupled between the second and fifth soldering point 135*b*, 135*e*. A fourth resistor R4 is coupled between the fourth and fifth soldering point 135*d*, 135*e*.

By means of the switching unit 136 either a first or a third terminal of the sixth switches can be selected. Therefore, by means of the switching unit 136, two different wiring settings can be selected. This is advantageous as for example the US and the Canadian wiring settings can be fulfilled by the headset according to the present invention.

In switch position 1, the Canadian ATC wiring and in switch position 2 the international ATC wiring can be implemented.

It should be noted that apart from the seven soldering points 135*a* -135*g*, further soldering points can be provided. Additional electronic or electric components can be connected to the soldering points. For example a further switch for a rectifier for the bipolar function of the microphone can be connected to an eighth and ninth soldering point.

The invention claimed is:

1. Headset, comprising:

a cable having a plug coupled to a first end of the cable, a connector coupled to a second end of the cable, a housing arranged between the first and second end of the cable and a cable section between the plug and the housing, wherein the plug comprises at least one pin and six terminals, wherein the cable section comprises six wires, wherein the housing comprises a connecting unit having a switching unit which is connected to the six wires and soldering areas to which wires of a headset can be coupled, the soldering areas comprising at least seven soldering points, wherein the switching unit comprises six switches and is adapted to switch between at least two wiring settings connecting the six wires to the soldering areas, wherein a first terminal of a first switch is coupled to a first soldering point, wherein a third terminal of the first switch is coupled to a sixth soldering point, wherein a first terminal of a second switch is coupled to a third soldering point, wherein a third terminal of the second switch is coupled to a seventh soldering point, wherein a first terminal of a third switch is coupled to the sixth soldering point, wherein a third terminal of the third switch is coupled to a push-to-talk switch, wherein a first terminal of a fourth switch is coupled to the seventh soldering point, wherein a third terminal of the fourth switch is coupled to a fifth soldering point, wherein the first terminal of the fourth switch is coupled to the push-to-talk switch, wherein the third terminal of the fourth switch is coupled to the first soldering point, wherein a first terminal of a fifth switch is coupled to the push-to-talk switch, and wherein a third terminal of the fifth switch is coupled to the third soldering point.

2. Cable for a headset, comprising:

a plug coupled to a first end of the cable, a connector coupled to a second end of the cable, a housing arranged between the first and second ends of the cable and a cable section between the plug and the housing, wherein the plug comprises at least one pin and six terminals, wherein the cable section comprises six wires, wherein the housing comprises a connecting unit having a switching unit which is connected to the six wires and soldering areas to which wires of a headset can be coupled, the soldering areas comprising at least seven soldering points, wherein the switching unit comprises six switches and is adapted to switch between at least two wiring settings connecting the six wires to the soldering areas, wherein a first terminal of a first switch is coupled to a first soldering point, wherein a third terminal of the first switch is coupled to a sixth soldering point, wherein a first terminal of a second switch is coupled to a third soldering point, wherein a third terminal of the second switch is coupled to a seventh soldering point, wherein a first terminal of a third switch is coupled to the sixth soldering point, wherein a third terminal of the third switch is coupled to a push-to-talk switch, wherein a first terminal of a fourth switch is coupled to the seventh soldering point, wherein a third terminal of the fourth switch is coupled to a fifth soldering point, wherein the first terminal of the fourth switch is coupled to the push-to-talk switch, wherein the third terminal of the fourth switch is coupled to the first soldering point, wherein a first terminal of a fifth switch is coupled to the push-to-talk switch, and wherein a third terminal of the fifth switch is coupled to the third soldering point.

* * * * *

UNITED STATES PATENT AND TRADEMARK OFFICE

CERTIFICATE OF CORRECTION

PATENT NO. : 8,133,073 B2
APPLICATION NO. : 12/756069
DATED : March 13, 2012
INVENTOR(S) : Jorg Buchberger et al.

It is certified that error appears in the above-identified patent and that said Letters Patent is hereby corrected as shown below:

Column 2, Line 12: please delete “market” and insert --markets--.

Column 2, Line 26: please delete “FIG.” and insert --FIGS.--.

Column 2, Line 33: please delete “FIG.” and insert --FIGS.--.

Column 2, Line 34: please delete “1a” and insert --1A--.

Column 2, Line 36: please delete “with two pins 111” and insert --with one pin 111 (e.g., FIG. 1A), or with two pins 111 (e.g., FIG. 1B)--.

Column 2, Line 40: please delete “fastening for example to” and insert --fastening, for example, to--.

Column 2, Line 55: before “form” please insert --the--.

Column 2, Line 62: please delete “FIG.” and insert --FIGS.--.

Column 2, Line 63: please delete “cable section 120” and insert --the internal wiring of cable section 120,--.

Column 3, Line 14: after “housing 130” please insert --, as shown in FIGS. 1A and 2A--.

Column 3, Line 61: please delete “point” and insert --points--.

Column 3, Line 62: please delete “point” and insert --points--.

Column 3, Line 65: please delete “point” and insert --points--.

Column 3, Line 67: please delete “sixth” and insert --six--.

Column 4, Line 13: before “ninth” please insert --a--.

Signed and Sealed this
Eighteenth Day of December, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,133,073 B2
APPLICATION NO. : 12/756069
DATED : March 13, 2012
INVENTOR(S) : Jorg Buchberger et al.

It is certified that error appears in the above-identified patent and that said Letters Patent is hereby corrected as shown below:

In the Specification:

Column 1, Line 55: please delete "fourth switch" and insert --fifth switch--.

Column 1, Line 56: please delete "fourth switch" and insert --fifth switch--.

Column 1, Line 58: please delete "fifth switch" and insert --sixth switch--.

Column 1, Line 59: please delete "fifth switch" and insert --sixth switch--.

Column 3, Line 54: please delete "fourth switch" and insert --fifth switch--.

Column 3, Line 55: please delete "fourth switch" and insert --fifth switch--.

Column 3, Line 56: please delete "fifth switch" and insert --sixth switch--.

Column 3, Line 58: please delete "fifth switch" and insert --sixth switch--.

In the Claims:

Column 4, Line 50, Claim 1: please delete "fourth switch" and insert --fifth switch--.

Column 4, Line 52, Claim 1: please delete "fourth switch" and insert --fifth switch--.

Column 4, Line 54, Claim 1: please delete "fifth switch" and insert --sixth switch--.

Column 4, Line 56, Claim 1: please delete "fifth switch" and insert --sixth switch--.

Column 6, Line 7, Claim 2: please delete "fourth switch" and insert --fifth switch--.

Column 6, Line 9, Claim 2: please delete "fourth switch" and insert --fifth switch--.

Signed and Sealed this
Ninth Day of June, 2015

Michelle K. Lee

Michelle K. Lee
*Director of the United States Patent and Trademark Office*

Column 6, Line 11, Claim 2: please delete “fifth switch” and insert --sixth switch--.

Column 6, Line 13, Claim 2: please delete “fifth switch” and insert --sixth switch--.